US006679215B2

(12) United States Patent
Benson et al.

(10) Patent No.: US 6,679,215 B2
(45) Date of Patent: Jan. 20, 2004

(54) INJECTION-MOLDED AIR INTAKE MANIFOLD FOR A V-STYLE ENGINE

(75) Inventors: Debra L. Benson, Penfield, NY (US); David Chinnici, Rochester, NY (US); Dominic N. Dalo, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/998,252

(22) Filed: Nov. 30, 2001

(65) Prior Publication Data

US 2003/0101957 A1 Jun. 5, 2003

(51) Int. Cl.[7] ..... F02M 35/10
(52) U.S. Cl. ..... 123/184.34; 123/184.61
(58) Field of Search ..... 123/184.61, 184.34, 123/184.57

(56) References Cited

U.S. PATENT DOCUMENTS 4,440,120 A * 4/1984 Butler ..... 123/184.34
5,127,371 A * 7/1992 Ogawa et al. ..... 123/184.34
5,211,139 A * 5/1993 Houle et al. ..... 123/184.61
5,575,249 A * 11/1996 Mielke et al. ..... 123/184.61
5,636,605 A * 6/1997 Nomizo et al. ..... 123/184.61
5,947,073 A * 9/1999 Chaffin et al. ..... 123/184.61
6,021,753 A * 2/2000 Chaffin et al. ..... 123/184.61
6,095,105 A * 8/2000 Lohr et al. ..... 123/184.34
6,161,513 A * 12/2000 Lohr et al. ..... 123/184.34
6,199,530 B1 * 3/2001 Brassell et al. ..... 123/184.34
6,202,627 B1 * 3/2001 Akima ..... 123/184.34
6,267,093 B1 * 7/2001 Lohr ..... 123/184.61

* cited by examiner

*Primary Examiner*—Henry C. Yuen
*Assistant Examiner*—Jason Benton
(74) *Attorney, Agent, or Firm*—Patrick M. Griffin

(57) ABSTRACT

An improved air intake manifold for a V-style internal combustion engine comprising three individual injection molded sections joined by friction welding of flanged mating elements. Each section is formed of a high-melting temperature composite polymer. The welds are all on the exterior of the manifold. The mating surfaces are formed to be directly accessible to welding apparatus and are so oriented that friction welding may be carried out by relative motion between the components in the axial direction. When joined, the lower and middle sections form the individual air distribution runners from the plenum to the intake ports in the engine heads. The lower and middle sections are so configured that each such runner crosses the valley of the engine, providing great strength and rigidity to the module. All runners are identical, so that air flows from the plenum to the individual cylinders are substantially identical. The middle and upper sections may be rotationally symmetrical about a vertical axis, preventing mis-orientation during assembly. Modifications may be made to any one of the sections without requiring retooling of molds for the other two sections, provided the configurations of the mating surfaces are unchanged.

5 Claims, 6 Drawing Sheets

INJECTION-MOLDED AIR INTAKE MANIFOLD FOR A V-STYLE ENGINE

TECHNICAL FIELD

The present invention relates to intake manifolds for internal combustion engines; more particularly, to such manifolds formed of a polymer; and most particularly, to an intake manifold module formed by vibration welding of a plurality of injection-molded components.

BACKGROUND OF THE INVENTION

An internal combustion engine, powered by either diesel fuel or gasoline, includes generally an intake manifold assembly for collecting air from outside the engine and distributing the collected air to each of the combustion cylinders. In modern engines, the manifold typically is part of a relatively complex assembly known generally in the art as an integrated air/fuel module (IAFM). The IAFM may include a variety of sub-systems for performing a host of related functions, including, for example, a throttle body and valve for air flow control, a helmholz resonator for noise suppression, an exhaust gas recirculation valve for mixing exhaust gas into the fresh air stream, a fuel rail and fuel injectors for injecting fuel to the cylinders, and a purge valve for stripping fuel from a fuel tank cannister.

Historically, intake manifolds were formed of metal such as cast iron or aluminum by molding around a sand-cast core, a costly manufacturing technique wherein the integrity of the core was destroyed by the heat of the molten metal, allowing the sand to be poured from the interior of the cooled component. More recently, intake modules are known in the art to be formed of high-temperature thermoplastic composites such as glass-filled nylon or glass-filled polyphthalamide by "lost core" molding, a technique related to sand casting wherein a sacrificial internal core, formed typically of a tin/bismuth alloy having a relatively low melting temperature, is destroyed after the molding process.

It is highly desirable to form an intake module by less-expensive forming techniques such as injection molding, wherein a component is formed by filling a cavity between an inner and an outer mold. The shape of the component must be such that the inner mold can be released and extracted from the part upon solidification of the molding material, a requirement that heretofore has generally dictated use of a sacrificial inner mold.

Recently, it is known in the art to form an intake module for an in-line engine by injection molding matable components which may be assembled as by welding to form a finished module. However, injection molding has not been available heretofore for the formation of a satisfactory IAFM for a V-style engine because of 1) very tight tolerances required in bridging across the valley between the left- and right-bank cylinder heads, and 2) great difficulty in reliably welding mating surfaces of components within the module.

Further, in known intake manifolds, the runners carrying air from a central plenum to the individual cylinders may differ in length and/or geometry, which is undesirable because the various cylinders may experience differing air/fuel ratios. It is preferred that the runners be identical, so that each cylinder is supplied identically with air.

Therefore, there is a strong need for an improved integrated air/fuel module for a V-style engine wherein the intake manifold may be assembled from injection molded components.

It is a principal object of this invention to provide an improved intake manifold formed of components which may be readily molded by injection molding and assembled by friction welding.

It is a further object of this invention to provide an improved intake manifold wherein the air flow paths between a plenum and the individual cylinders are identical.

It is a still further object of this invention to provide an improved intake manifold formed of welded components wherein the weld integrity of each air flow runner may be readily tested.

It is a still further object of this invention to provide an improved intake manifold having superior mechanical rigidity for installation as a bridge across the heads of a V-style engine.

SUMMARY OF THE INVENTION

Briefly described, the present invention is directed to an improved air intake manifold for a V-style internal combustion engine. The manifold is assembled from three individual injection molded sections by friction welding of mating surfaces. Preferably, each section is formed of a high-melting temperature composite polymer, such as glass-filled nylon or glass-filled polyphthalamide. The mating surfaces are all on the exterior of the manifold and are so formed as to be directly accessible to welding apparatus, including clamping devices. Further, the mating surfaces are so oriented that friction welding may be carried out by relative motion between the components in the axial direction. When joined, the lower and middle sections form the individual distribution runners from the plenum to the intake ports in the engine heads. The lower and middle sections are so configured that each such runner crosses the valley of the engine, providing great strength and rigidity to the module. Further, all runners are identical, so that air flows from the plenum to the individual cylinders are substantially identical. Preferably, the middle and upper sections are rotationally symmetrical about a vertical axis orthogonal to the longitudinal axis of the module, such that each may be added to the module during assembly in either of two orientations 180° apart, making mis-orientation impossible. Modifications may be made to any of the sections, as may be required for example to adapt the manifold to a specific engine IAFM requirement, without requiring retooling of molds for the other two sections, provided the configurations of the mating surfaces are unchanged.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which.

DESCRIPTION OF THE PREFERRED EMBODIMENTS

Figure 7:
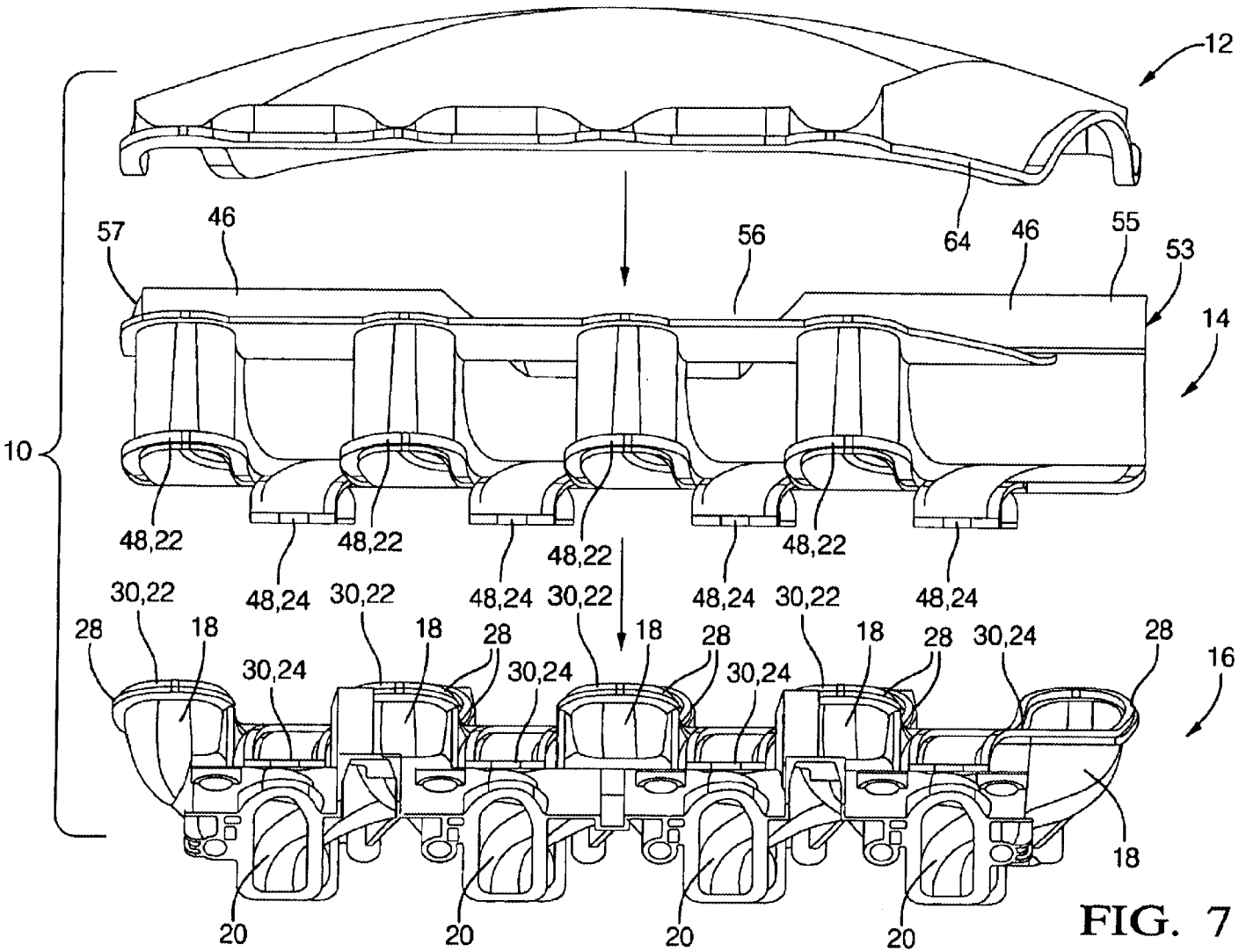
FIG. 7 is an exploded elevational view of the upper, middle, and lower sections shown in FIG. 1.

Referring to FIGS. 1 through 3 and 6, an improved air intake manifold 10 in accordance with the invention includes an upper section 12, a middle section 14, and a lower section 16, which are assemblable as shown in FIG. 7 to form manifold 10. Each of sections 12, 14, 16 is configured to be formed by injection molding of a suitable thermally-liquefied polymer into an injection mold having inner and outer reusable molds. Formation of these sections does not require a lost-core inner mold, as in the prior art. Auxiliary side slides also may be required, as is known in the art of injection molding. Preferably, such molded sections are formed of a high-melting temperature composite polymer, such as glass-filled high-temperature nylon or glass-filled polyphthalamide which are readily available from commercial sources.

Lower section 16, having a longitudinal axis 17, includes the lower portions 18 of individual air distribution runners, each terminating distally in a port 20 matable with a corresponding intake port (not shown) in a left or right head 22, 24 of a V-style engine 26 (FIG. 6) having an included angle 25 between the heads. Heads 22, 24 are arranged longitudinally and generally symmetrically about an engine plane of symmetry 27. Lower portions terminating in left-head ports are designated 18-22, and lower portions terminating in right-head ports are designated 18-24. Each of lower portions 18-22 and 18-24 terminates proximally in an opening fully surrounded by a flange 28 extending axially of portion 18 and having a respective mating surface 30-22 or 30-24. Preferably, all of the mating surfaces 30-22 are coplanar and mating surfaces 30-24 are coplanar, and all are contained in planes or surfaces parallel to axis 17. Adjacent ones of flanges 28 preferably are axially separated by at least about 2 mm. Preferably, all of lower portions 18-22 are identical in size and shape, as are all of lower portions 18-24; and further, portions 18-22 are mirror image configurations of portions 18-24 (when reversed end-for-end).

Lower section 16 further includes a plurality of injector ports 32, a one of each opening into each of runner ports 20 for receiving a fuel injector (not shown) during final assembly of a finished IAFM. Section 16 further includes towers 34 containing bores 36 for receiving mounting screws for fuel rails (not shown) incorporating the fuel injectors, and a plurality of bores 38 for receiving bolts (not shown) for securing section 16 to the engine heads 22, 24. Any of various known gasket types (not shown) may be incorporated as desired between section 16 and heads 22, 24.

Figure 1:
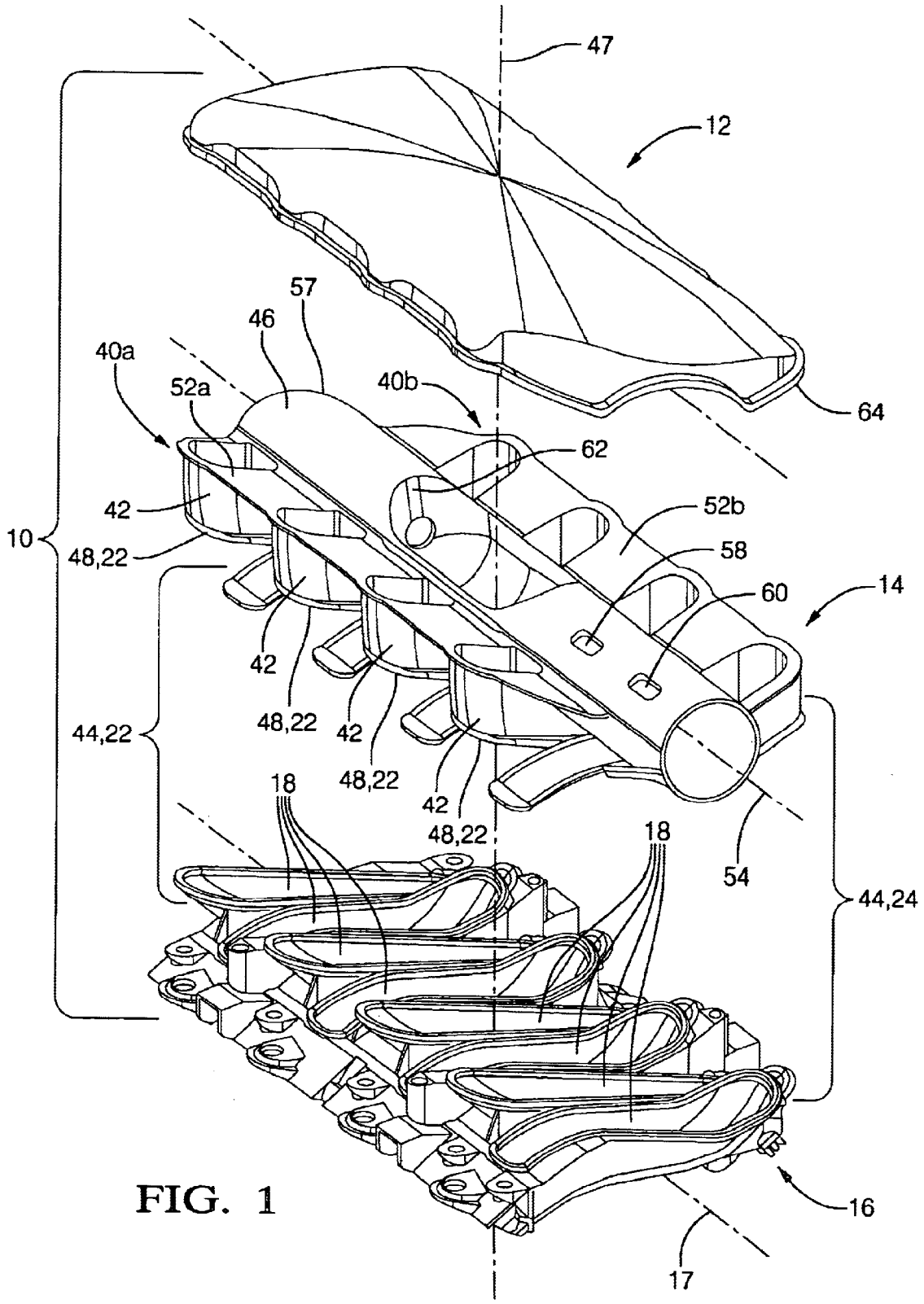
FIG. 1 is an exploded isometric view from above of an improved air intake manifold in accordance with the invention, showing the relationship of the upper, middle, and lower sections.
Figure 2:
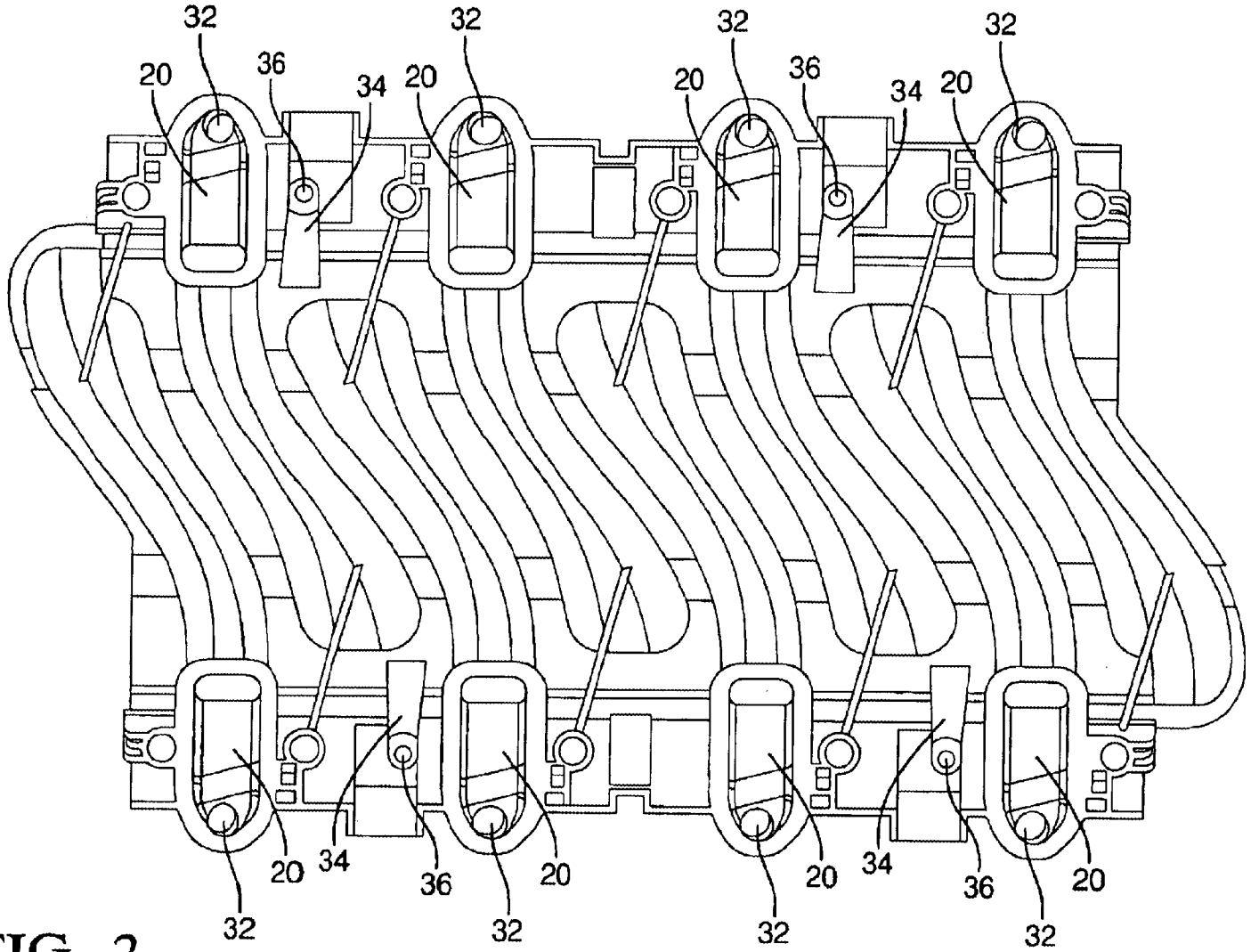
FIG. 2 is a bottom plan view of the lower section, and hence of the manifold.
Figure 3:
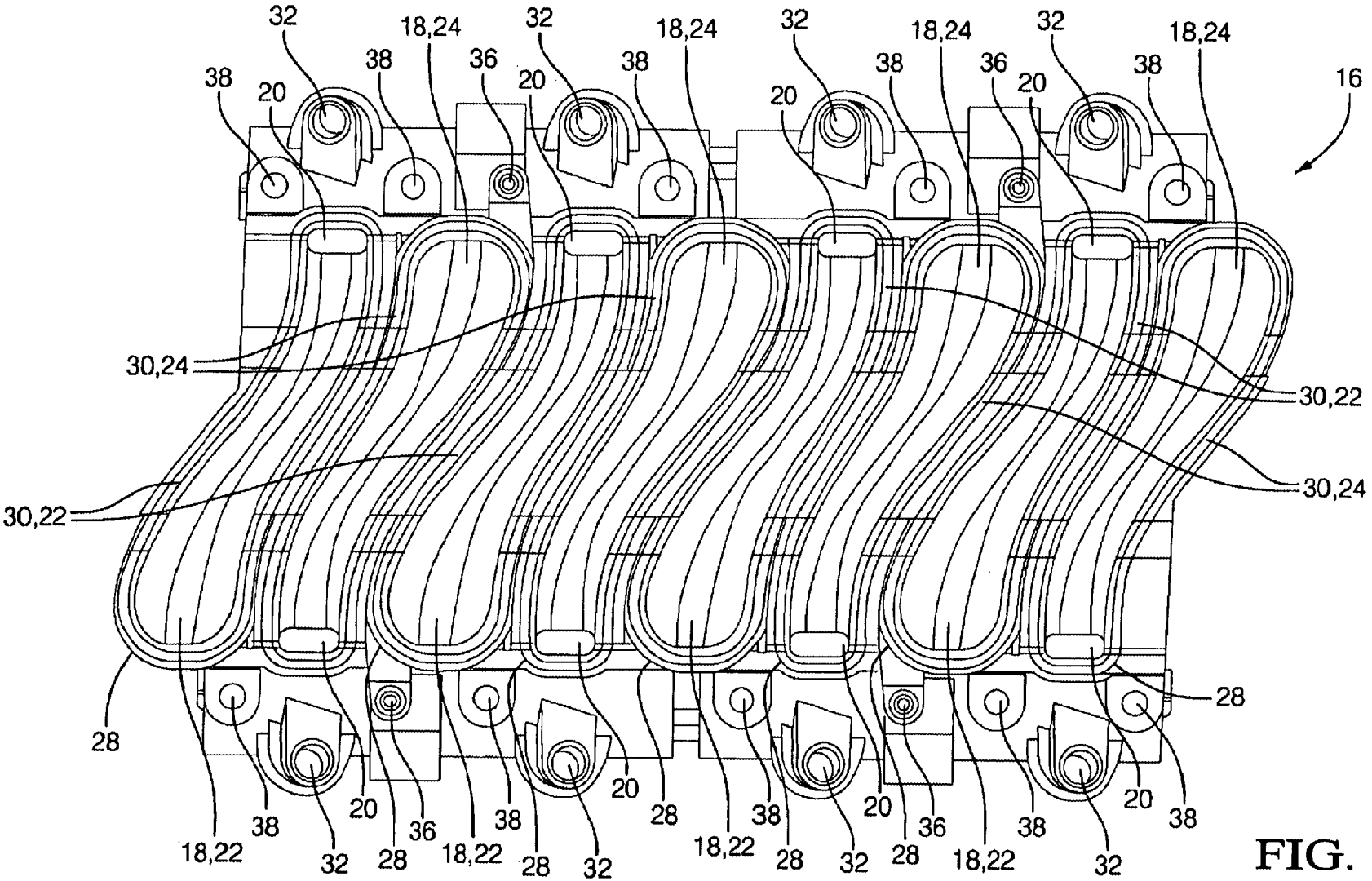
FIG. 3 is a top plan view of the lower section, showing the runners crossing the manifold.
Figure 4:
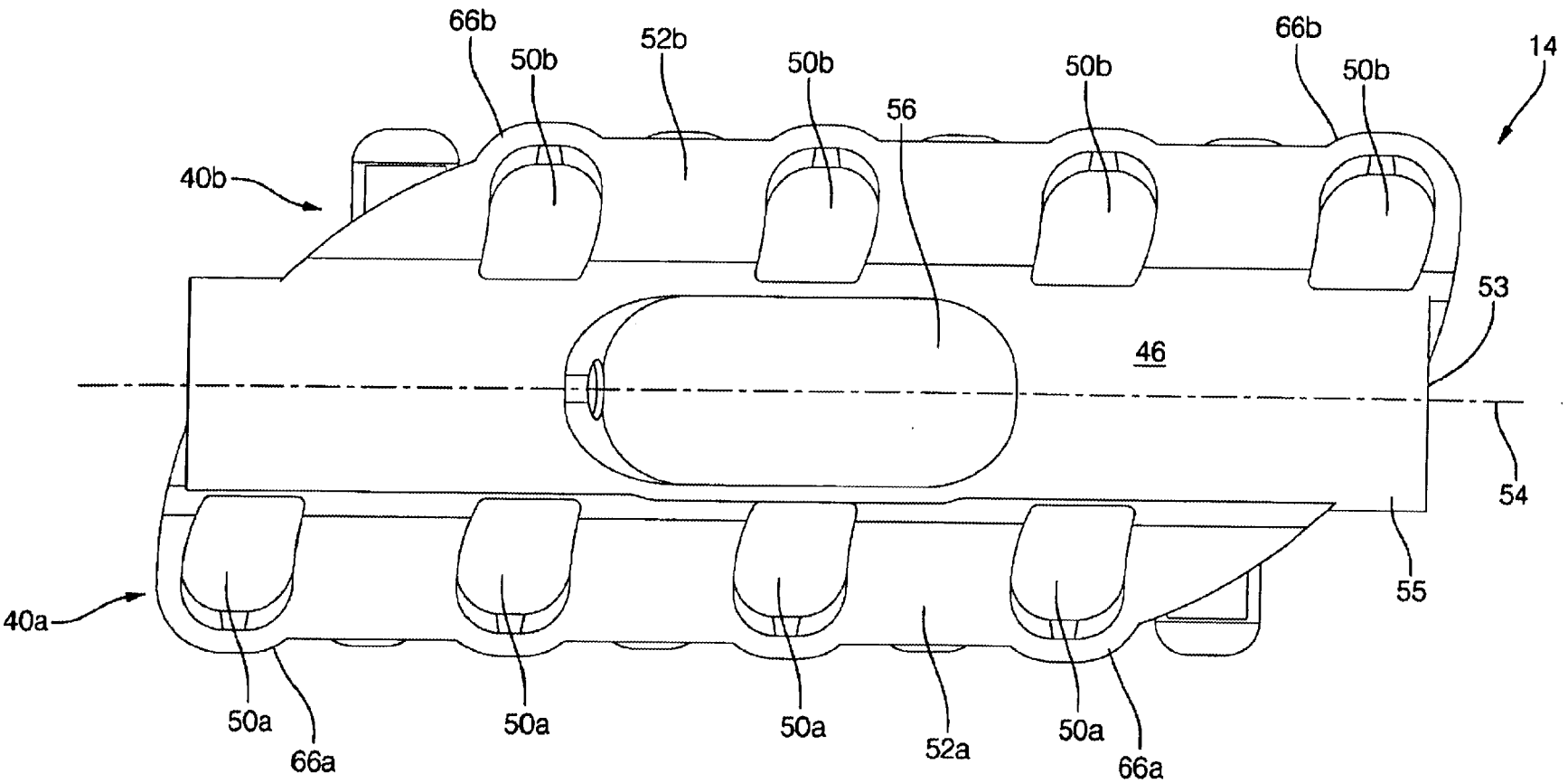
FIG. 4 is a top plan view of the middle section, showing the zip tube, entrance to the plenum, and entrances to the individual runners.

Referring to FIGS. 1, 4, and 7, middle section 14 includes a first bank 40*a* and a second bank 40*b* of upper portions 42 of individual air distribution runners 44 disposed along opposite sides of a central zip tube 46. Each upper portion 42 crosses beneath zip tube 46 and terminates distally in an opening (not visible in the drawings) and flange 48. As in the lower element, there are left flanges 48-22 and right flanges 48-24. Each flange has a surface substantially identical to and matable with respective lower portion surfaces 30-22, 30-24 to form left- and right-runners 44-22, 44-24, respectively.

Each upper portion 42 in banks 40*a*, 40*b* terminates proximally in an opening 50 in a planar element 52 disposed longitudinally along zip tube 46 in a plane parallel to a plane containing axis 54 of middle section 14. Openings 50*a* in planar element 52*a* lead to runners 44-24, and openings 50*b* in planar element 52*b* lead to runners 44-22, all runners crossing under tube 46 as previously described and passing through engine symmetry plane 27. Preferably, elements 52*a* and 52*b* are not coplanar but rather are mutually inclined in order to properly shape the entrance regions of runners 44. Preferably, middle section 14 is rotationally symmetrical about vertical axis 47 such that section 14 may be oriented either as shown in FIG. 1 or upon 180° rotation about axis 47, to equal effect, such that openings 50*a* then lead to runners 44-24 and openings 50*b* lead to runners 44-22.

Zip tube 46 includes an air intake port 53 at a proximal end 55 and an air exhaust port 56 in a central region of the tube, and may include other ports for auxiliary systems, for example, port 58 for an EGR valve and port 60 for a purge valve in known fashion. Intake port 53 may receive a throttle valve body (not shown) in known fashion. Preferably, the distal end 57 of zip tube 46 is closed by a helmholz resonator 62 for damping resonant sonic frequencies in the air intake system.

Figure 5:
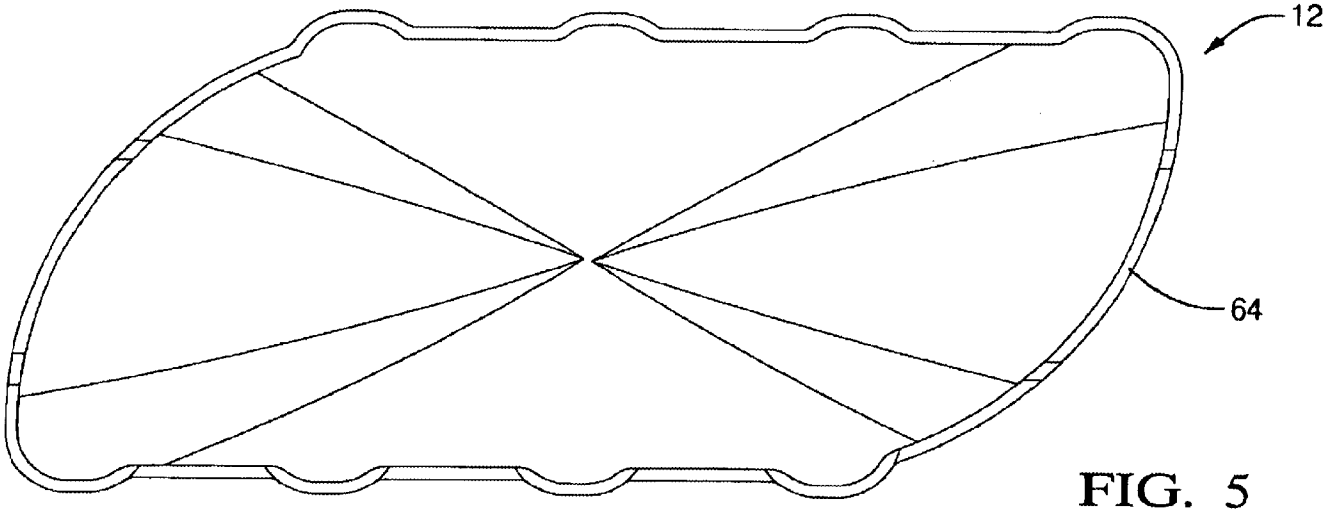
FIG. 5 is a bottom plan view of the underside of the upper section.
Figure 6:
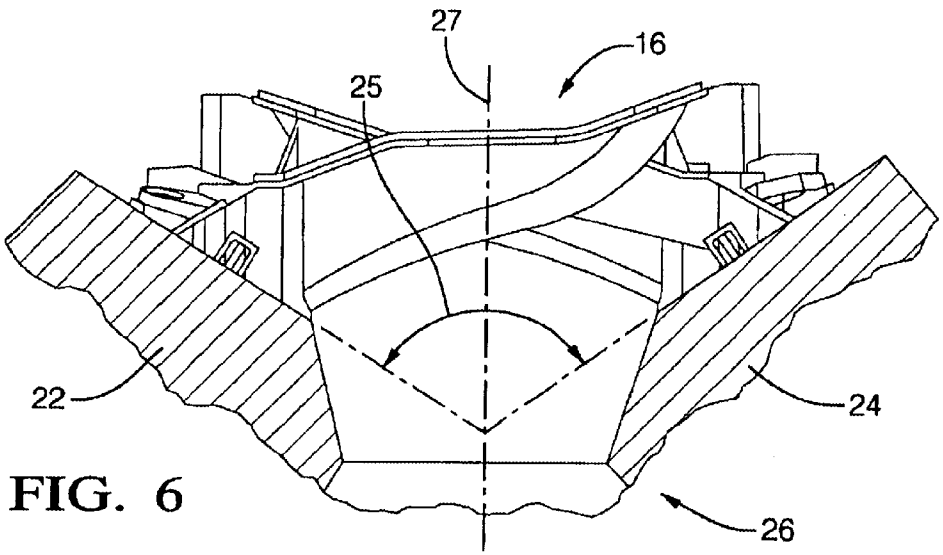
FIG. 6 is an end view of the lower section shown in FIGS. 1 through 3.

Referring to FIGS. 1 and 5, upper section 12 is slightly dome-shaped both axially and radially and is provided with a flange 64 configured to mate conformably with zip tube 46 and planar elements 52*a,b* along the outer edges 66*a,b* thereof. When section 12 is thus sealably mated to middle section 14, a plenum is created therebetween for receiving intake air from tube exhaust port 56 and distributing the air to runners 44 via openings 50*a,b*. Like middle section 14, upper section 12 is also preferably rotationally symmetrical about vertical axis 47 and may be installed in either of two 180° opposed orientations.

Sections 12, 14, 16 may be joined by any suitable means, as by adhesives or clamps, but preferably by thermal welding of all mating surface, and most preferably by vibration (friction) welding. As described above, the mating surfaces all lie parallel to the axes of their respective sections. Thus each surface may be axially displaced by a small distance relative to its opposite mate. Vibration, or friction, welding requires such relative movement, on the order of +/−1 mm, which is permitted in the axial direction by the careful arrangement of the mating surfaces. Further, all mating flanges extend axially from their respective openings such that mating flanges may be captured over their entire lengths between a sonic horn and a back-up tool, thus ensuring highly reliable welding of all surfaces. It is an important advantage of an air intake manifold in accordance with the invention that all welds are on outer surfaces of the manifold and thus are readily visible for inspection; and further, that all flanges 28 and 48 are continuous around each runner and are not shared, so that leakage of air between runners is not possible; and further, that each runner may be individually tested for weld integrity (leaks) as desired.

In an alternative embodiment of manifold 10, sections 12, 14, 16 may be die-cast of aluminum or other metal and welded along the outer edges of the respective flanges; however, the injection-molded polymeric embodiment is currently preferred.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention. Therefore, it is intended that the invention not be limited to the particular embodiments disclosed as the best mode contemplated for carrying out this invention, but that the invention include all embodiments falling within the scope and spirit of the appended claims.

What is claimed is:

1. An air intake manifold for collecting ambient air and distributing the air to individual cylinders of a V-style internal combustion engine, said intake manifold having injection-molded components joined by welding, wherein said intake manifold comprises:

a) a lower section including lower portions of air distribution runners;

b) a middle section including upper portions of said air distribution runners, said upper portions cooperating with said lower portions to form said runners to distribute air to said engine cylinders; and c) an upper section for cooperating with said middle section to form a plenum for distributing air to said runners, wherein said V-style engine has a plane of symmetry, and wherein said engine has left and right heads disposed on opposite sides of said plane, and wherein each of said runners passes through said plane in distributing air from said plenum to said engine cylinders.

2. An air intake manifold for collecting ambient air and distributing the air to individual cylinders of a V-style internal combustion engine, said intake manifold having injection-molded components joined by welding, wherein said intake manifold comprises:

a) a lower section including lower portions of air distribution runners;

b) a middle section including upper portions of said air distribution runners and a helmholz resonator, said upper portions cooperating with said lower portions to form said runners to distribute air to said engine cylinders; and c) an upper section for cooperating with said middle section to form a plenum for distributing air to said runners.

3. An air intake manifold for collecting ambient air and distributing the air to individual cylinders of a V-style internal combustion engine, said intake manifold having injection-molded components joined by welding, wherein said intake manifold comprises:

a) a lower section including lower portions of air distribution runners;

b) a middle section including upper portions of said air distribution runners, said middle section is rotationally symmetrical about an axis orthogonal to a longitudinal axis thereof, said upper portions cooperating with said lower portions to form said runners to distribute air to said engine cylinders; and c) an upper section for cooperating with said middle section to form a plenum for distributing air to said runners.

4. An air intake manifold for collecting ambient air and distributing the air to individual cylinders of a V-style internal combustion engine, said intake manifold having injection-molded components joined by welding, wherein said intake manifold comprises:

a) a lower section including lower portions of air distribution runners;

b) a middle section including upper portions of said air distribution runners, said upper portions cooperating with said lower portions to form said runners to distribute air to said engine cylinders;

c) an upper section for cooperating with said middle section to form a plenum for distributing air to said runners; and d) a zip tube integrally molded into said middle section.

5. A V-style internal combustion engine having an air intake manifold, said intake manifold having injection-molded components joined by welding, wherein said intake manifold comprises:

a) a lower section including lower portions of air distribution runners;

b) a middle section including upper portions of said air distribution runners and a zip tube, said upper portions cooperating with said lower portions to form said runners to distribute air to said engine cylinders; and c) an upper section for cooperating with said middle section to form a plenum for distributing air from said zip tube to said runners.

* * * * *